US005694731A

United States Patent [19]

Tönsmann et al.

[11] Patent Number: 5,694,731

[45] Date of Patent: Dec. 9, 1997

[54] FIRE RESISTANT FRAME STRUCTURE FOR WINDOWS, DOORS, FACADES OR GLASS ROOFS

[75] Inventors: Armin Tönsmann, Leopoldshöhe; Frank Mantwill, Bielefeld; Siegfried Habicht, Leopoldshöhe; Eitel-Friedrich Höcker, Bielefeld, all of Germany

[73] Assignee: Schüco International KG, Bielefeld, Germany

[21] Appl. No.: 568,931

[22] Filed: Dec. 7, 1995

[30] Foreign Application Priority Data

Dec. 8, 1994 [DE] Germany ..... 44 43 762.5

[51] Int. Cl.[6] ..... E04C 2/26

[52] U.S. Cl. ..... 52/656.3; 52/204.1; 52/232; 49/504; 49/DIG. 1

[58] Field of Search ..... 52/656.3, 656.2, 52/232, 204.1; 49/504, DIG. 1

[56] References Cited

U.S. PATENT DOCUMENTS

| | | | |
|---|---|---|---|
| 1,092,931 | 4/1914 | McClellan | 52/656.3 |
| 4,850,173 | 7/1989 | Beyer et al. | 52/232 X |
| 5,347,780 | 9/1994 | Richards et al. | 52/232 X |
| 5,469,683 | 11/1995 | McKenna et al. | 52/656.2 X |

*Primary Examiner*—Christopher Kent
*Attorney, Agent, or Firm*—Henry M. Feiereisen

[57] ABSTRACT

A fire resistant frame structure for windows, doors, facades or glass roofs, includes a metallic structural element for connection to at least one other metallic structural element to form a frame. Secured to the outside and/or inside of the frame are slabs of adsorbent material which retain a high water content and exhibit heat absorbing and hydrophilic properties. The slabs of adsorbent material react or are activated at a certain temperature level to release their water content in order to cool the frame.

29 Claims, 6 Drawing Sheets

FIRE RESISTANT FRAME STRUCTURE FOR WINDOWS, DOORS, FACADES OR GLASS ROOFS

BACKGROUND OF THE INVENTION

The present invention refers to a fire resistant frame structure, and in particular to a fire resistant frame structure composed of metallic structural elements for use as frames for windows, doors, facades or glass roofs.

German. Pat. No. 29 48 039 A1 discloses a fire resistant door with at least one swingable leaf that supports a glass pane, for protection against fire and smoke. The door has a frame structure of two tubular steel subframes that are spaced from one another to receive a heat insulation of inflammable material therebetween. By means of screws or bolts, the heat insulation and the steel subframes are braced together to provide the frame structure with sufficient stability. The steel subframes generally are capable to withstand a rise in temperature that is encountered during fires. Thus, the purpose of the heat insulation between the subframes is merely to prevent a temperature increase beyond a desired level on the fire-distal side of the door. In this type of configuration, the door is made at least on the fire-proximal side of a material which has a melting point that is greater than the expected temperature during fire as defined by the empirical standard temperature curve.

In addition, the frame structure according to German Pat. No. 29 48 039 A1 is further enclosed by an outer covering frame of aluminum to impart an aluminum character to the overall construction. However, this outer aluminum frame typically melts during fire.

A drawback of this conventional fire resistant door is the combination of different materials to form the frame structure. On the one hand, the use of steel results in a considerable weight of the overall construction, and on the other, different materials require different handling and joining processes. Also, the attachment of an outer aluminum frame to cover the frame structure is cumbersome and complicated.

SUMMARY OF THE INVENTION

It is an object of the present invention to provide an improved fire resistant frame structure, obviating the aforestated drawbacks.

In particular, it is an object of the present invention to provide an improved fire resistant frame structure which allows the use of light metal such as aluminum on the fire-proximal side even when the melting point of such material is lower than the temperature prevalent during fire while still preventing a melting of the light metal frame structure over a predetermined period.

These objects, and others which will become apparent hereinafter, are attained in accordance with the present invention by lining the outside and/or inside of the metallic frame structure with an adsorbent material which retains a high water content and exhibits heat absorbing and hydrophilic properties.

The frame structure is preferably made of two structural elements of light metal such as aluminum which are joined together by a mid-assembly of metal across which the heat flux is decreased in comparison to heat flux across the structural elements. The adsorbent material is attached to the frame structure in form of slabs or otherwise suitably shaped pieces and preferably is made of alum and gypsum. Alum is a so-called double sulfates of trivalent metals which are capable of storing a considerable weight of water of crystallization. Especially suitable is potassium alum (or potassium aluminum sulfate) of the chemical formula $KAl(SO_4)_2 \times 12H_2O$. Potassium alum is capable of physically binding about 45% of water of crystallization per weight unit. The release of water of crystallization from the potassium alum in pure form takes place at 73° C. Alum has a density of 1.1 g/cm$^3$ so that the fraction of retained water of crystallization is about 50% by volume.

Potassium alum may also be embedded in a gypsum matrix and is absolutely neutral with regard to the hardening process of the gypsum. Thus, slabs, formed pieces and profiles which are made from such material composition have sufficient stability for application in fire protection. The combination of potassium alum and gypsum is advantageous because the components do not significantly alter their individual characteristics, i.e. potassium alum will not adversely affect the curing process of the gypsum, and gypsum will not adversely affect the water retention capability of alum.

Preferably, the adsorbent material is made of 50% of a modified gypsum and 50% of potassium alum. As gypsum as well as alum have a same density of 1.1 g/cm$^3$, this ratio governs whether it is based on weight or volume. The energy consumption of adsorbent material based on such composition is about 1,100 J/cm$^3$.

The mixing ratio between alum and gypsum may however be varied to suit different situations. At a mixing ratio of 1:1 between gypsum and alum the fraction of retained water of crystallization is about 32%.

Taken alone, potassium alum has an effective temperature of 73° C., while in combination with gypsum, the effective temperature is shifted to a higher value of about 85° C. because water released by alum will be absorbed by the gypsum component and retained therein up to a temperature of about 85° C. before being evaporated. This results in a favorable effective temperature which is at a level sufficiently above possible ambient temperatures which may in certain situations reach 70° C. when the adsorbent material is exposed to direct sun radiation.

The combination of gypsum and alum for use as adsorbent material has the further advantage that water of crystallization retained in gypsum is released only at an effective temperature of 125° C. Thus, the release of water of crystallization is staggered over several stages to thereby positively influence the cooling action of the frame structure which is lined with adsorbent material. Moreover, at about a temperature of 250° C., a slight release of additional water retained in gypsum is effected. This release is however less crucial.

In accordance with one embodiment of the present invention, the mid-assembly that joins the structural elements together may be formed by connection plates that are received in respective anchoring grooves formed on the structural elements. In order to decrease the heat flux across its surface, the connection plates are formed with spaced punched holes of various configuration to reduce the surface area across which heat can be transferred from the fire-proximal side to the fire-distal side of the structural elements.

According to another embodiment of the present invention, the mid-assembly may be formed by a C-shaped main body of plastic material which has opposing profiled ends that are received in the complementary anchoring grooves of the structural elements. In order to provide a metallic connection between the structural elements, the opposing ends of the mid-assembly are formed with spaced recesses for receiving complementary ends of metallic strip members which bridge the main body in parallel relationship thereto.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
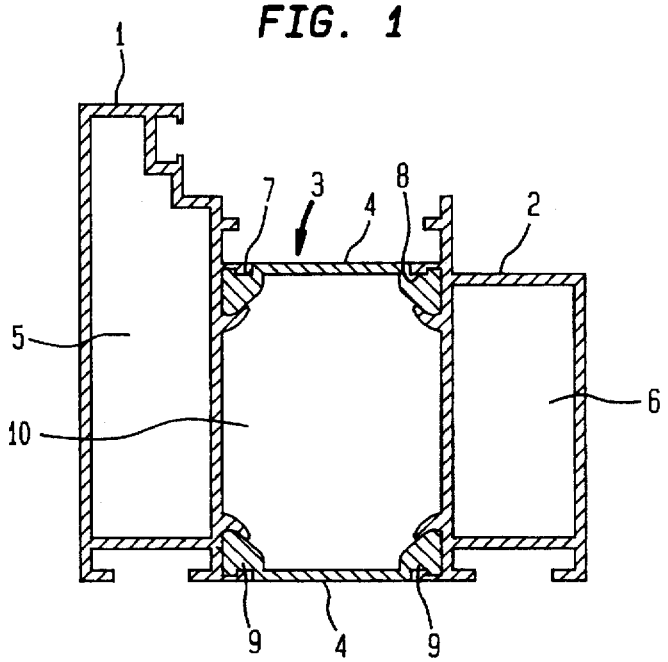
FIG. 1 is a sectional view of one embodiment of a composite frame structure according to the present invention formed by two structural elements joined together by a mid-assembly.

Throughout all the Figures, the same or corresponding elements are generally indicated by the same reference numerals.

Turning now to the drawing, and in particular to FIG. 1, there is shown a sectional view of one embodiment of a frame structure according to the present invention, including two extruded tubular structural elements 1, 2 of light metal such as aluminum which have an enclosed cross section of generally rectangular configuration and may be open or closed at their axial ends to thereby exhibit interior chambers 5, 6. The structural elements 1, 2 are joined together by a mid-assembly, generally designated by reference numeral 3 to thereby form a further interior chamber 10. The frame structure thus exhibits three interior chambers 5, 6, 10. As will be described in more detail furtherbelow, the interior chambers 5, 6, 10 may be fully or at least partially filled or lined with adsorbent material in form of slabs 22 (FIG. 4) that have heat absorbing, hydrophilic properties and retain a high content of water of crystallization.

The mid-assembly 3 is composed of two connection plates 4 that extend in parallel relationship to each other and have projecting profiled borders 7 for attachment in complementary anchoring grooves 8 formed integrally on opposing sides of the structural elements 1, 2 between projecting webs 9 that extend outwardly from the structural elements 1, 2. After placement of the borders 7 in the anchoring grooves 8, the connection plates 4 are secured in place by the outer webs 9. The connection plates 4 may be made of aluminum or any other suitable metal, such as steel, and are characterized by a heat flux across their surfaces which is reduced in comparison to the heat flux across the structural elements 1, 2.

Figure 2A:
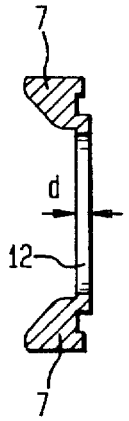
FIG. 2*a* is a sectional view of the mid-assembly, taken along the line II—II in FIG. 2.
Figure 2:
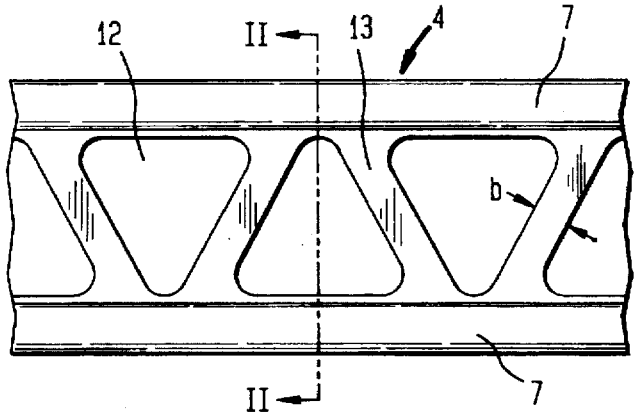
FIG. 2 is a fragmentary plan view of the mid-assembly for use in a frame structure according to the present invention.

As shown in FIG. 2, the connection plates 4 are provided in the area between the borders 7 with punched holes 12 in form of isosceles triangles that are evenly spaced from one another in such a manner that neighboring triangles 12 are inverted relative to each other. Thus, slanted narrow webs 13 are formed between the triangles 12 of a width b and a thickness d (FIG. 2*a*). Heat can thus be transferred from the structural elements 1, 2 across these webs 13 whereby the amount of heat transferred across the surface of the webs 13 can be adjusted, i.e. increased or decreased, through variation of the width b and thickness 3 of the webs 13. In case of fire, heat is thus conducted only across the webs 13 from the external structural elements 1, 2 to the fire-distal side of the frame structure.

Figure 3:
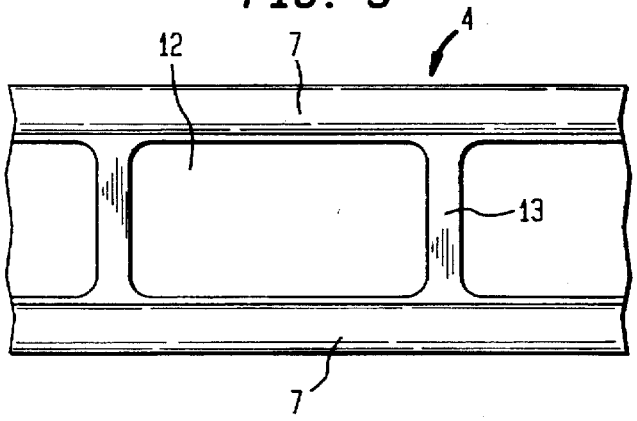
FIG. 3 is a fragmentary plan view of a modified embodiment of a mid-assembly for use in the frame structure according to the present invention.

FIG. 3 shows a modified configuration of the connection plates 4 which is formed with holes 12 of rectangular configuration for defining straight webs 13 therebetween for heat conduction. It will be understood by persons skilled in the art that the configurations of the holes 12 as shown in FIGS. 2 and 3 are only preferred examples, and it is certainly within the scope of the present invention to configure the holes 12 in any other suitable geometrical shape. For static and strength reasons, the triangular configuration of the holes 12 in alternating alignment, as shown in FIG. 2, has proven advantageous.

Figure 4:
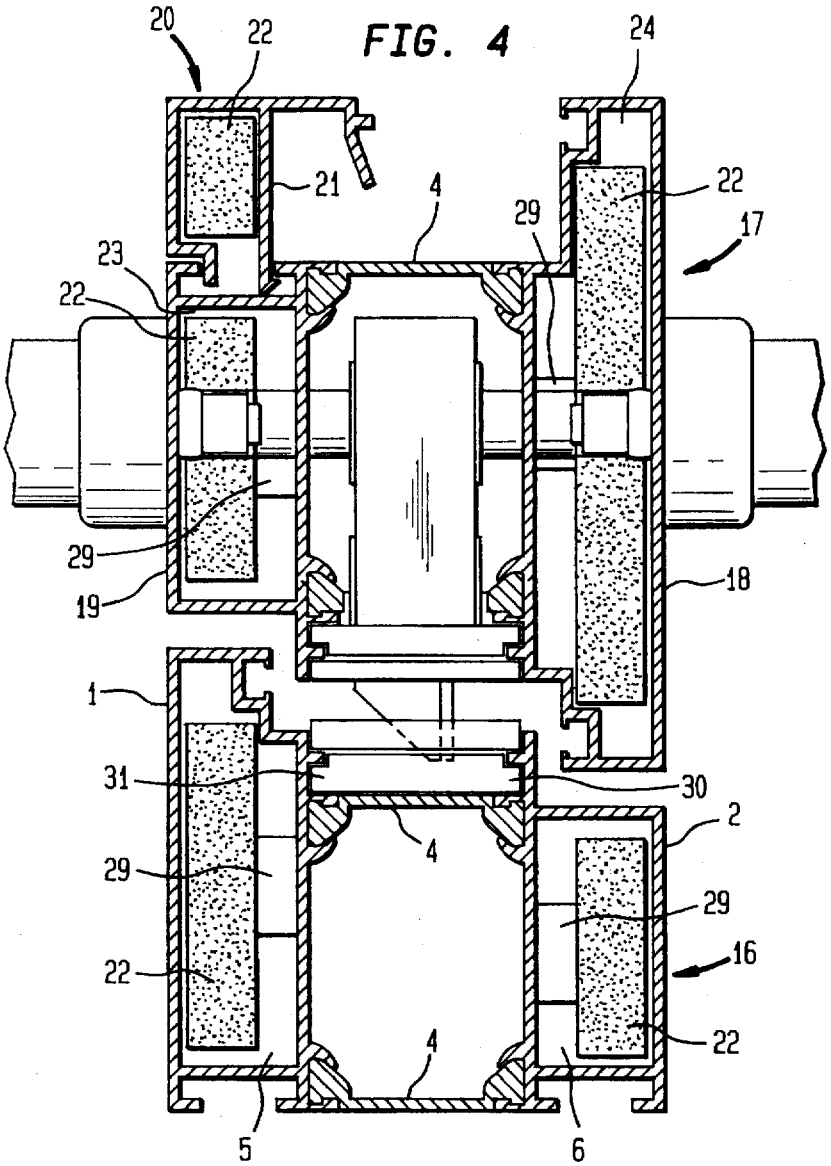
FIG. 4 is a sectional view of a frame structure according to the present invention for use as a door frame.

Turning now to FIG. 4, there is shown a sectional view of a frame structure according to the present invention for use as door frame. The frame structure is composed of an inner subframe, generally designated by reference numeral 16 and configured in a manner according to FIG. 1. The subframe 16 is thus composed of the structural elements 1, 2 which exhibit interior chambers 5, 6. The structural elements 1, 2 are joined together by the mid-assembly 3 in form of the two connection plates 4 which, as described above, are formed with punched holes 12 to reduce the heat flux across the connection plates 4.

The frame structure further includes an outer subframe, generally designated by reference numeral 17 and including structural elements 18, 19 that form the exterior parts of the frame structure and are made of a light metal such as aluminum. The structural elements 18, 19 are of hollow configuration to define interior chambers 23, 24 and are joined together by connection plates 4 to serve as heat insulation.

Attached to the outer subframe 17 via a snap connection is a further subframe, generally designated by reference numeral 20 for supporting a glass pane (not shown) together with the subframe 17. The subframe 20 exhibits an interior chamber 21.

Figure 4A:
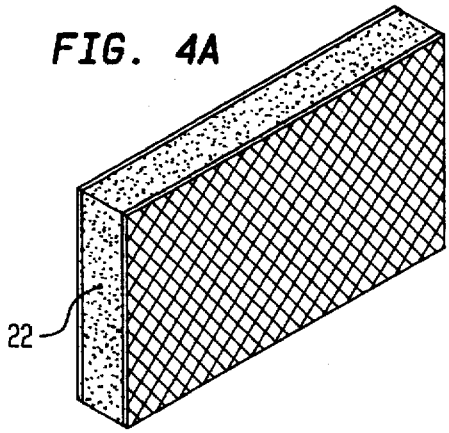
FIG. 4*a* is a perspective view of an exemplified slab member for incorporation in the frame structure.

As shown in FIG. 4, the interior chambers 5, 6, 21, 23, 24 of the frame structure are lined with adsorbent material in form of slabs 22 that are preferably composed of an alum and gypsum mixture which is capable of retaining a high fraction of water of crystallization and has heat absorbing and hydrophilic properties. In addition, the outer layer of the slabs 22 or otherwise formed pieces may have embedded therein fabric, as shown in FIG. 4*a* preferable glass fiber fabric.

It will be understand by persons skilled in the art that the slabs 22 of adsorbent material may also be composed of different components of which at least one component should be capable of retaining a high content of water of crystallization for release at a temperature below the melting temperature of the light metal components that are subjected to fire. Thus, as the temperature rises on the fire-proximal side of the frame structure, water of crystallization retained in the adsorbent material will be released after the temperature reaches a certain level, thereby cooling the metal frame structure.

Figure 8:
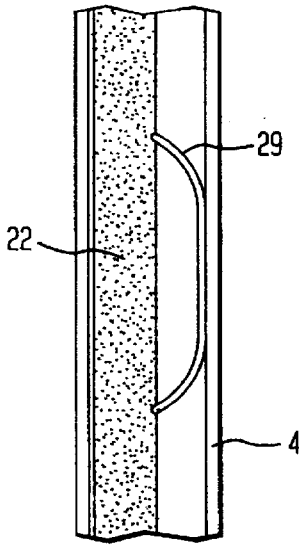
FIG. 8 is a detailed illustration of a spring member for securing adsorbent material to the frame structure of FIG. 7.

The slabs 22 of adsorbent material are pushed into the interior chambers 5, 6, 21, 23, 24 and secured therein by metal springs 29 which, as best seen in FIG. 8, dig with their free ends into the adsorbent material to secure it in place. Screws may also be used in order to attach the slabs 22 to the subframes.

It will be understood by persons skilled in the art that the slabs of adsorbent material may be shaped in any suitable form and may have any suitable length to best suit the configuration of the interior chambers 5, 6, 21, 23, 24 of the frame structure. The adsorbent material may also be filled into the interior chambers 5, 6, 21, 23, 24 in form of a liquid phase and subsequently allowed to cure into a solid substance inside the interior chambers. As surfaces of doors are frequently treated, e.g. through powder coating, the introduction of liquid adsorbent material into the interior chambers 5, 6, 21, 23, 24 should be carried out following a possible surface treatment of the frame structure so as to prevent the adsorbent material from being subjected to drying temperatures of the powder coating process which reach levels at which the adsorbent material is responsive, i.e. releases water of crystallization.

Figure 7:
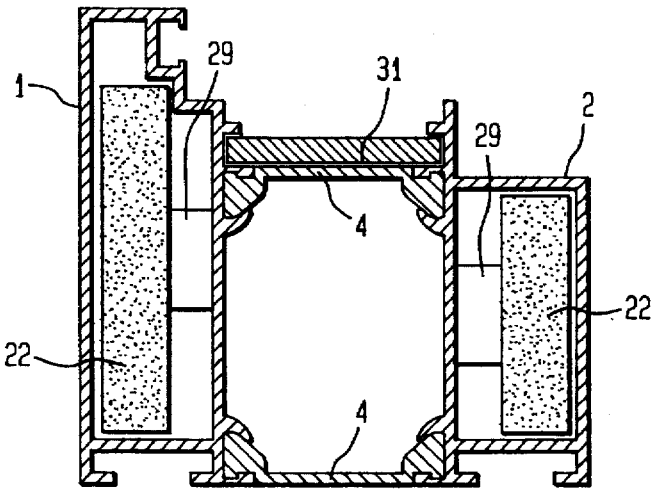
FIG. 7 is a sectional view of the frame structure of FIG. 1, with interior chambers being lined with adsorbent material and with a fire protection strip secured to cover the mid-assembly.

In the area between the inner subframe 16 and the outer subframe 17, the structural elements 5, 6 and 18, 19 are formed with F-shaped projections that oppose each other to define grooves 30 for receiving fire protection strips 31 in proximity over the connection plates 4, as shown in particular in FIG. 7, to mask them from outside. Each fire protection strip 31 is made of a material which bloats or expands at rising temperature. Thus, in case of fire, the bloating material substantially closes this area to prevent a migration of smoke.

Normally, only the interior chambers 5, 6, 23, 24 of the inner subframe 16 and the outer subframe 17 are lined at their inside surface along the outer sides with slabs 22 of energy consuming adsorbent material, as shown in FIG. 4. In particular cases which require an increased temperature resistance beyond the designated period, also the interior chambers 10 of the mid-assembly 3 of the respective composite frame structure may be filled with energy consuming adsorbent material.

The holes of the metal plates 4, forming the mid-assembly 3 of the frame structure decrease the heat flux as the surface area for conduction of heat is reduced to the webs 13. The creation of a complete heat insulation as is typically the case for conventional fire resistant constructions and employed in window construction and door construction to generally accomplish a heat protection is neither desired nor intended by the frame structure according to the present invention. A heat flux is required in the area of the mid-assembly 3 of the metallic frame structure because not only the energy consuming adsorbent material that faces the fire must be activated to release water of crystallization but also the adsorbent material positioned on the fire-distal side of the frame structure. Thus, the frame structure can be configured of small design while still retaining a sufficient amount water so as to meet the requirements of a fire resistant construction with regard to surface temperatures and the resistance time of the frame structure when being subjected to fire.

The connection plates 4 are made from an extruded profile in which holes are punched out or from rolled steel and thus can be separately prefabricated and worked on, and then attached to the structural elements 1, 2 by any suitable joining process.

The slabs 22 of adsorbent material are suitably composed in such a manner as to respond to a temperature in the area between 80° C. to 150° C.

In those cases in which the fire-proximal side is already known when fabricating the frame structure, the filling of the interior chambers of the structural elements 1, 2 with slabs 22 of adsorbent material may be suited to need and may be different for each chamber. For example, a higher filling degree may be suitable on the fire-proximal side than on the fire-distal side to thereby define higher response temperatures on the fire-proximal side than on the fire-distal side. These characteristics can be accomplished by suitably selecting the components of the adsorbent material.

Figure 5:
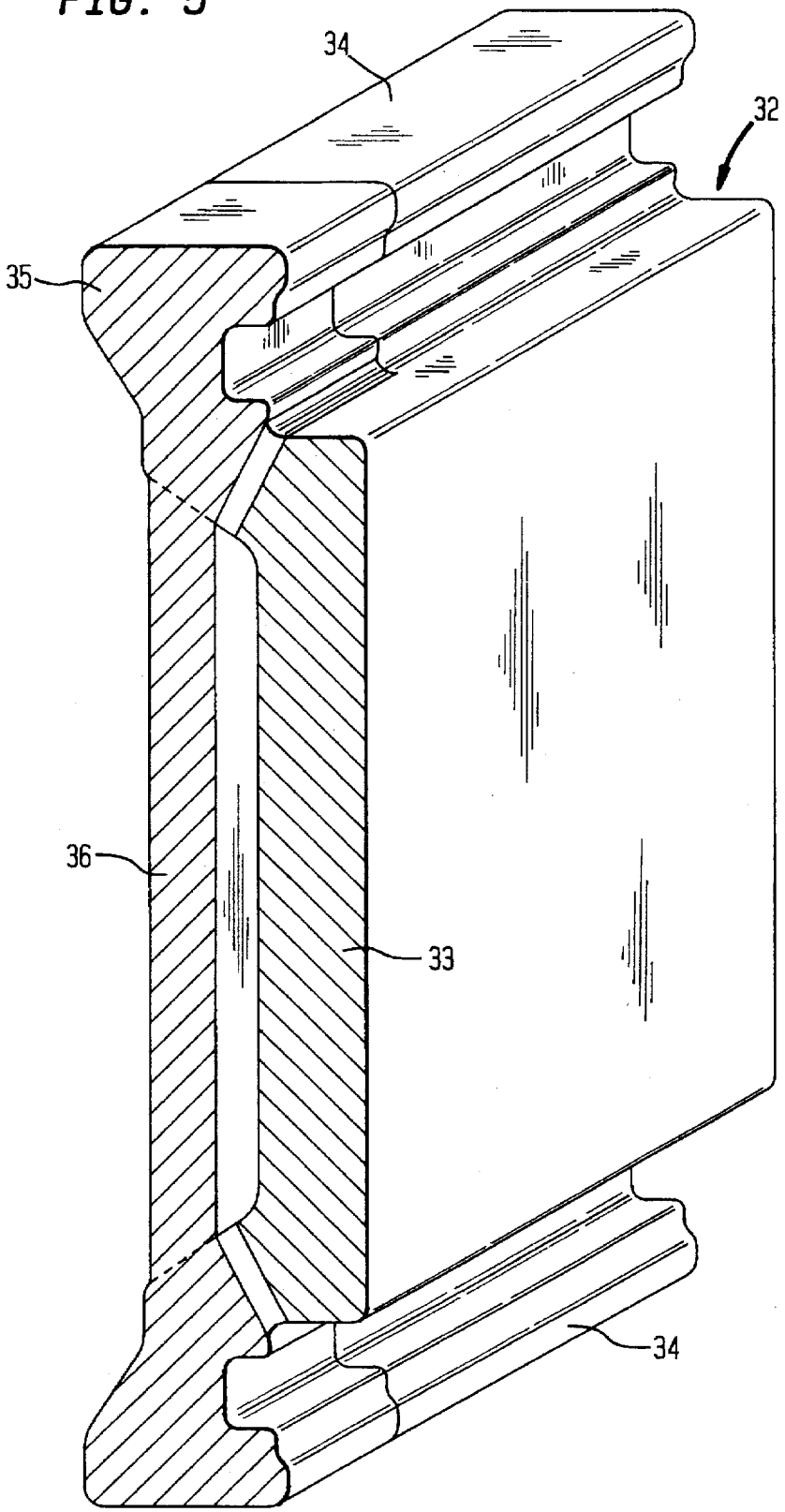
FIG. 5 is a perspective, sectional view of a modified mid-assembly for joining structural elements of a frame structure according to the present invention.

Turning now to FIG. 5, there is shown a variation of a mid-assembly 3 between the structural elements 1, 2 in form of a multi-part insulation, generally designated by reference numeral 32. The insulation 32 is formed by an extruded plastic panel 33 of poor heat conduction which extends over the entire length of the insulation assembly 32 and is configured along its longitudinal extremities in form of with profiled borders 34. These profiled borders 34 are preferably recessed at equal distances for receiving complementary profiled end pieces 35 of strips 36 which bridge the panels 33 and are made of metal, preferably aluminum. The complementing profiled borders 34 and end pieces 35 are secured in the anchoring grooves 7 of the structural elements 1, 2. The metallic strips 36 ensure a heat flux between the structural elements 1, 2, whereby the heat flow between the structural elements 1, 2 can be best suited by adjusting the width of and the spacing between the strips 36.

Figure 6:
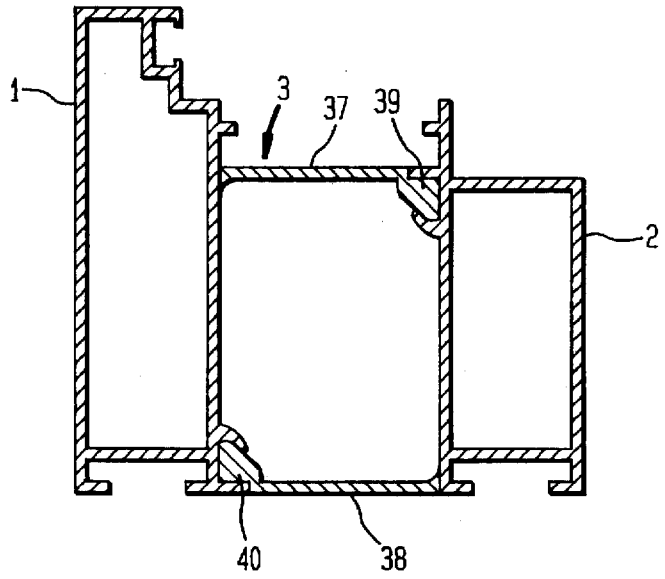
FIG. 6 is a sectional view of another embodiment of a frame structure according to the present invention.

Turning now to FIG. 6, there is shown a variation of the mid-assembly 3 between the structural elements 1, 2 to form a heat insulation zone. The mid-assembly 3 is formed by holed metal plates 37, 38 which extend integrally from the respective structural elements 1, 2. The metal plate 37 which is formed integrally with the structural element 1 and extends perpendicular therefrom in direction to the structural element 2 is formed with a projecting border 39 which is received in the groove 7 of the structural element 2 while the metal plate 38 that is formed integrally with the structural element 2 and extends perpendicular therefrom in direction to the structural element 1 is received with its projecting border 40 in the groove 7 of the structural element 1. The metal plates 37, 38 are formed with punched holes 12 to exhibit a grid configuration shown in FIGS. 2 and 3, thereby decreasing the heat flux between the structural elements 1, 2.

Figure 9:
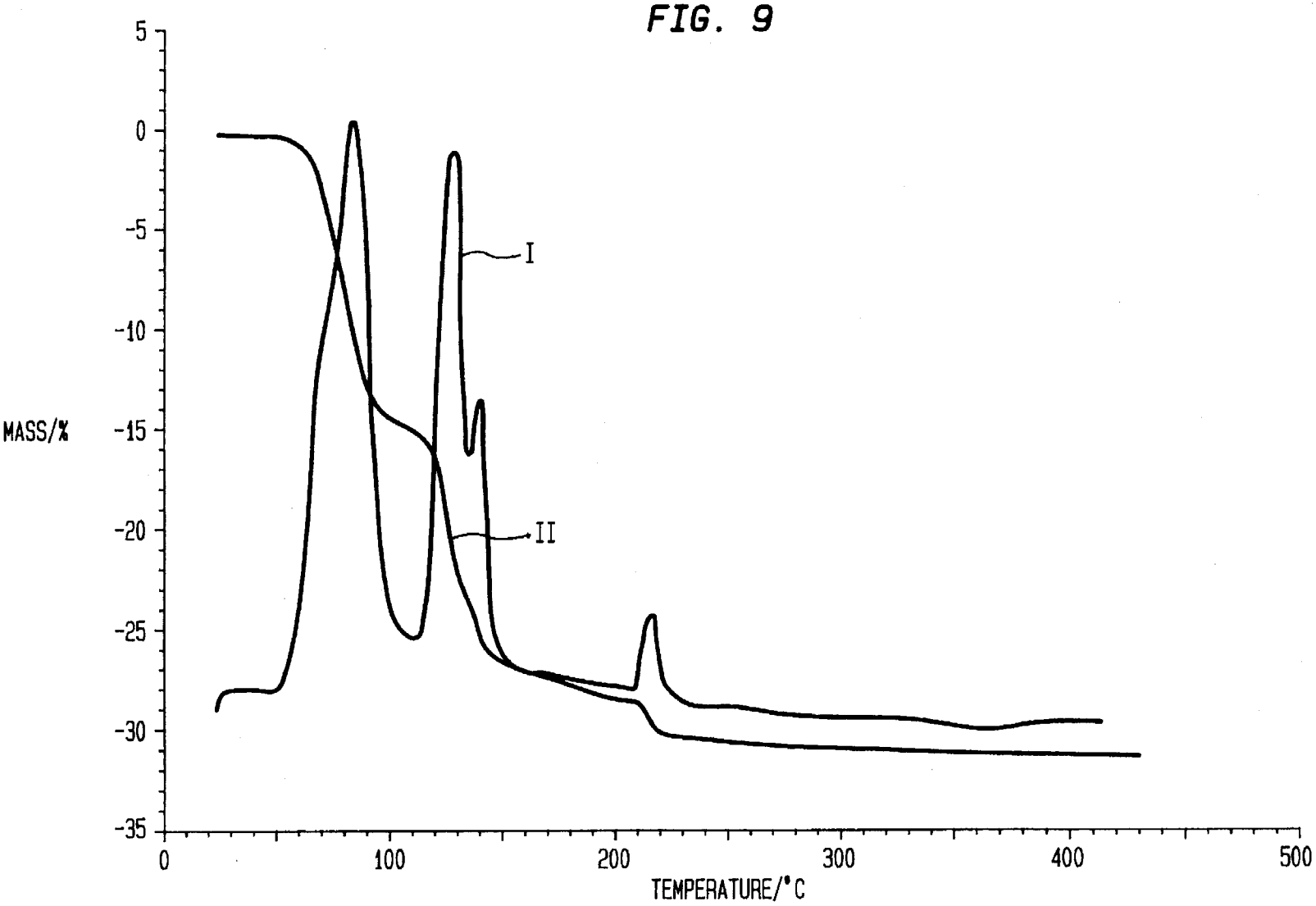
FIG. 9 is a graphical illustration showing a curve commensurate with the response time of adsorbent material on the basis of a potassium-alum-gypsum combination for release of water of crystallization as a function of the temperature, and another curve commensurate with a mass loss of adsorbent material as a function of the temperature.

FIG. 9 is a graphical illustration depicting characteristics of an adsorbent material made of potassium alum and gypsum.

Graph I shows the course of the response temperature of the adsorbent material as a function of the temperature. The peaks in the graph I indicate the release of water of crystallization at the particular temperatures and demonstrate the staggered release of water to effect the cooling process. The area beneath the graph I represents the total consumption of energy.

Graph II illustrates the loss of mass of adsorbent material during the temperature rise.

Figure 10:
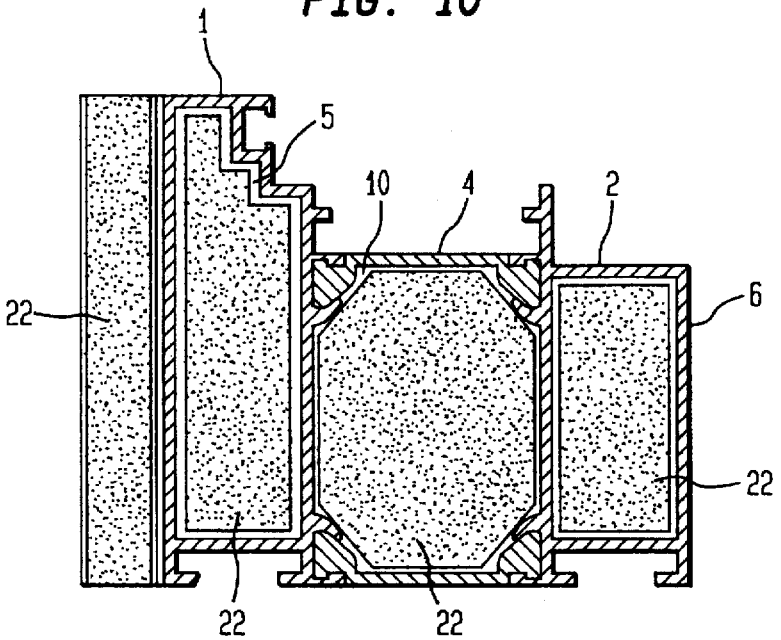
FIG. 10 is a sectional view of yet another embodiment of a frame structure according to the present invention.

Turning now to FIG. 10, there is shown a sectional view of a variation of the frame structure according to FIG. 1. The interior chambers 5, 6, and 10 are completely filled with adsorbent material 22 on the basis of e.g. alum and gypsum. In addition, a slab 22 of adsorbent material 22 is also attached to the outside of the structural element 1 so that in case of fire near the structural element 1, the adsorbent material 22 lined along the outside thereof is first activated to release the water of crystallization. When the fire persists over an extended period, the adsorbent material 22 inside the interior chambers 5, 6, 10 becomes activated to release the water of crystallization so that the frame structure is intensely cooled to ensure an extended life of the overall frame structure.

Figure 11:
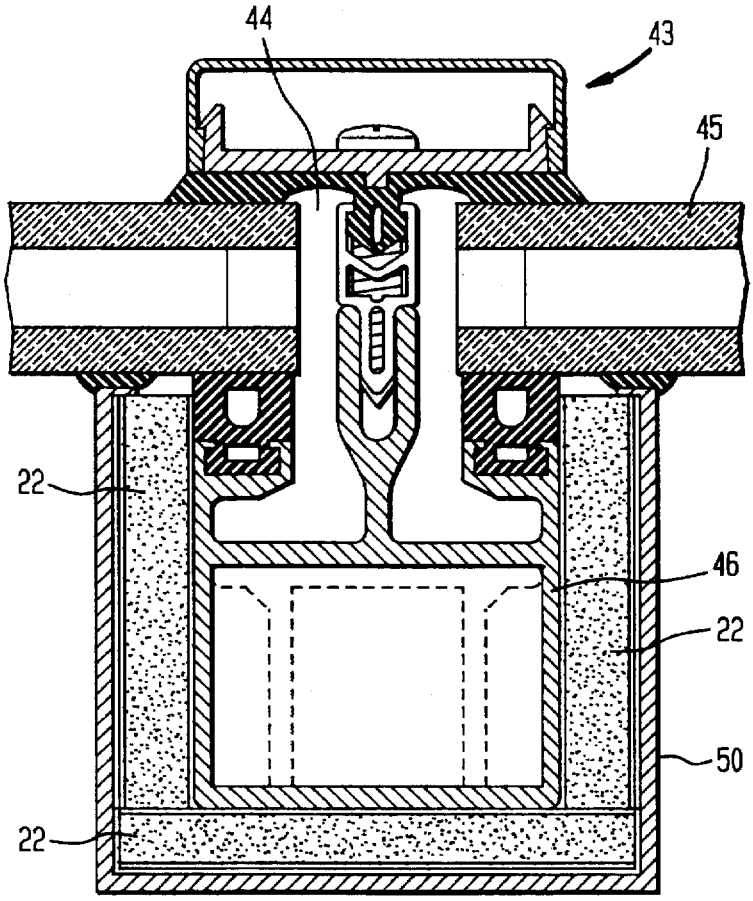
FIG. 11 is a sectional view of a frame structure according to the present invention in form of a main subframe in combination with a cover plate assembly, for use in a facade or glass roof construction.

FIG. 11 illustrates a facade construction or roof construction in which a main frame structure 46 is installed inside a room and carries suitably sealed glass panes 45 in conjunction with an external subframe 43 that is positioned on the outside and secured to the main frame 46 by suitable fastening means 44. The main frame 46 is made of aluminum and is lined along its exposed side faces by slabs 22 of adsorbent material which release water of crystallization at a certain temperature level to cool the main frame 46. The slabs 22 of adsorbent material may be connected to the main frame 46 through gluing or other mechanical means.

Preferably, the slabs 22 of adsorbent material which envelope the main frame 46 are additionally secured in place by a cover panel 50 of sheet metal, e.g. light metal or special steel.

While the previous description refers to frame structures with two structural elements of hollow configuration which are joined together by a mid-assembly 3 in form of holed connection plates 4 or composite insulations 32 according to FIG. 5, it is certainly within the scope of the present invention to provide a single-piece-structure which is extruded and formed with three interior chambers, with holes being punched in the middle area to reduce heat conduction in this region.

While the invention has been illustrated and described as embodied in a fire resistant frame structure for windows, doors, facades or glass roofs, it is not intended to be limited to the details shown since various modifications and structural changes may be made without departing in any way from the spirit of the present invention.

What is claimed as new and desired to be protected by Letters Patent is set forth in the appended claims.

We claim:

1. A fire resistant frame structure for windows, doors, facades or glass roofs, comprising:

a first metallic structural element;

at least a second metallic structural element for connection to the first structural element to form a frame defined by a longitudinal axis, said structural elements exhibiting an outside surface area and an inside surface area;

adsorbent material attached to the structural elements upon a surface area selected from the group consisting of the inside surface area and the outside surface area, said adsorbent material retaining a high water content and having heat absorbing and hydrophilic properties; and connecting means for joining the structural elements together, said connecting means exhibiting a surface area across which a heat flux is reduced in comparison to a heat flux across the structural elements.

2. The frame structure of claim 1 wherein the structural elements are made of light metal.

3. The frame structure of claim 2 wherein the structural elements are made of aluminum.

4. The frame structure of claim 1 wherein the connecting means is formed by a metal plate.

5. The frame structure of claim 4 wherein the plate exhibits web-like zones of reduced surface area of metal between the structural elements.

6. The frame structure of claim 1 wherein each of the structural elements is formed with at least one groove for securement of the connecting means.

7. The frame structure of claim 1 wherein the connecting means is an assembly of at least one panel of plastic material which extends over the entire length of the connecting means, and a metallic strip member bridging the panel in parallel relationship thereto and extending transversely to the longitudinal axis of the frame, said panel having opposing ends exhibiting recesses for receiving profiled ends of the metallic strip member.

8. The frame structure of claim 4 wherein the plate is made of one sheet metal strip formed with punched holes of random configuration to form a reduced surface area and to provide decreased heat flux.

9. The frame structure of claim 4 wherein the connecting means includes a plurality of plates in the form of several sheet metal strips in parallel relationship, with each sheet metal strip being formed with punched holes to form a reduced surface area and to provide decreased heat flux.

10. The frame structure of claim 8 wherein the sheet metal strip is made of aluminum.

11. The frame structure of claim 8 wherein the punched holes are provided in the form of triangles, with neighboring triangles being inverted relative to each other.

12. The frame structure of claim 4 wherein each of the structural elements exhibits an interior chamber, and wherein the connecting means defines with the structural elements a further interior chamber, said adsorbent material being selectively placed in said interior chambers.

13. The frame structure of claim 1 wherein each of the structural elements is a hollow section forming an interior chamber which is at least partially filled with adsorbent material.

14. The frame structure of claim 1, and further comprising a slab of adsorbent material attached to an outside surface of one of the structural elements.

15. The frame structure of claim 14 wherein the adsorbent material is provided in form of slabs that are attached to outside surfaces of the structural elements, with the slabs forming part of a closed frame.

16. The frame structure of claim 1, and further comprising a sheet metal covering for enveloping adsorbent material attached to an outside area of the structural elements.

17. The frame structure of claim 12, and further comprising metallic spring means for securing the adsorbent material in place within the interior chambers.

18. The frame structure of claim 1 and further comprising a fire protection strip retained by the first and second structural elements and extending adjacent the connection means, and said fire protection strip being made of a material bloating when subject to rising temperature.

19. The frame structure of claim 1 wherein the adsorbent material has an effective response temperature at which retained water is released, said response temperature being adjustable to allow individual activation of adsorbent material secured to the structural elements.

20. A fire resistant frame structure for windows, doors, facades or glass roofs, comprising:

a first metallic structural element;

at least a second metallic structural element for connection to the first structural element to form a frame defined by a longitudinal axis, said structural elements exhibiting an outside surface area and an inside surface area; and adsorbent material made of alum and gypsum and attached to the structural elements upon a surface area selected from the group consisting of the inside surface area and the outside surface area, said adsorbent material retaining a high water content and having heat absorbing and hydrophilic properties.

21. The frame structure of claim 20 wherein the structural elements are made of light metal.

22. The frame structure of claim 21 wherein the structural elements are made of aluminum.

23. The frame structure of claim 20 wherein the adsorbent material is made of potassium alum and gypsum, with the potassium alum being embedded in a matrix of gypsum.

24. The frame structure of claim 23 wherein the adsorbent material is made of potassium alum and a modified gypsum at a ratio of 1 to 1.

25. The frame structure of claim 20 wherein each of the structural elements is a hollow section forming an interior chamber which is at least partially filled with adsorbent material.

26. The frame structure of claim 25, and further comprising metallic spring means for securing the adsorbent material in place within the interior chamber.

27. The frame structure of claim 20 wherein the adsorbent material has an effective response temperature at which retained water is released, said response temperature being adjustable to allow individual activation of adsorbent material secured to the structural elements.

28. A fire resistant frame structure for windows, doors, facades or glass roofs, comprising:

a first metallic structural element;

at least a second metallic structural element for connection to the first structural element to form a frame defined by a longitudinal axis, said structural elements exhibiting an outside surface area and an inside surface area; and adsorbent material having an outer layer with fabric being embedded therein and attached to the structural elements upon a surface area selected from the group consisting of the inside surface area and the outside surface area, said adsorbent material retaining a high water content and having heat absorbing and hydrophilic properties.

29. The frame structure of claim 28 wherein the fabric is a glass fiber fabric.

* * * * *